US011136704B2

(12) United States Patent
Lasner et al.

(10) Patent No.: US 11,136,704 B2
(45) Date of Patent: Oct. 5, 2021

(54) FLANGE SHAFT DEVICE AND WASHING MACHINE

(71) Applicant: Miele & Cie. KG, Gütersloh (DE)

(72) Inventors: Steffen Lasner, Borgholzhausen (DE); Benedikt Fechtel, Rheda-Wiedenbrück (DE); Michael Scharmüller, Lenzing (AT); Klaus Grausgruber, Breitenschützing (AT)

(73) Assignee: Miele & Cie. KG, Gütersloh (DE)

( * ) Notice: Subject to any disclaimer, the term of this patent is extended or adjusted under 35 U.S.C. 154(b) by 164 days.

(21) Appl. No.: 16/617,593

(22) PCT Filed: May 25, 2018

(86) PCT No.: PCT/EP2018/063798

§ 371 (c)(1),
(2) Date: Nov. 27, 2019

(87) PCT Pub. No.: WO2018/219814

PCT Pub. Date: Dec. 6, 2018

(65) Prior Publication Data

US 2020/0181825 A1 Jun. 11, 2020

(30) Foreign Application Priority Data

Jun. 1, 2017 (DE) ..... 10 2017 112 136.6

(51) Int. Cl.

| | |
|---|---|
| ***D06F 37/04*** | (2006.01) |
| ***D06F 37/22*** | (2006.01) |
| *D06F 33/00* | (2020.01) |
| *D06F 37/26* | (2006.01) |
| *D06F 37/40* | (2006.01) |
| *D06F 39/12* | (2006.01) |

(52) U.S. Cl.

CPC ..... *D06F 37/04* (2013.01); *D06F 37/22* (2013.01); *D06F 33/00* (2013.01); *D06F 37/268* (2013.01); *D06F 37/40* (2013.01); *D06F 39/12* (2013.01)

(58) Field of Classification Search

CPC ..... D06F 37/04

See application file for complete search history.

(56) References Cited

FOREIGN PATENT DOCUMENTS

| | | |
|---|---|---|
| DE | 19532783 A1 | 3/1996 |
| EP | 1798322 A1 | 6/2007 |

OTHER PUBLICATIONS

European Patent Office, Rijswijk, Netherlands, International Search Report of International Application No. PCT/EP2018/063798, dated Aug. 24, 2018, 2 pages.

*Primary Examiner* — Jason Y Ko

(74) *Attorney, Agent, or Firm* — Dickinson Wright PLLC

(57) ABSTRACT

A flanged-shaft apparatus (1) is configured for rotatably supporting a drum (4) in a washing machine having such a flanged-shaft apparatus (1). The flanged-shaft apparatus (1) has a connecting flange (2) configured to be arranged against a drum base (41) of the drum (4) and attached to the drum (4), and a drive shaft (3) arranged in the center of the connecting flange (2) and connected thereto for connection to a drive motor. The connecting flange (2) has a main element (21) formed from a steel sheet and a supporting element (22) formed from a further steel sheet. The main element (21) and the supporting element (22) are arranged one on top of the other along a longitudinal axis (L) of the drive shaft (3).

15 Claims, 4 Drawing Sheets

FLANGE SHAFT DEVICE AND WASHING MACHINE

TECHNICAL FIELD

The invention relates to a flanged-shaft apparatus for rotatably supporting a drum in a washing machine, as well as to a washing machine having such a flanged-shaft apparatus.

BACKGROUND

The secure and load-bearing suspension of a drum in a tub of a front-loaded drum-type washing machine is a very delicate matter. Because the drum must be free towards the washing machine opening, the drum can only be attached at the rear end, i.e. on the circular drum base. A flange usually provided for this purpose connects the drum base to a drive shaft of a drive apparatus that in turn is responsible for rotatably driving the drum. The flange and the drive shaft thus form a unit that is referred to below as a flanged shaft or as a flanged-shaft apparatus. This flanged-shaft apparatus is usually attached to the drum base or to a drum shell of the drum and must transmit the torque of the drive apparatus from the drive shaft to the drum.

At the same time, the flanged-shaft apparatus must be capable of absorbing any forces due to any imbalance. Such an imbalance arises if laundry is distributed asymmetrically in the drum, but also already arises if the tub is in part filled with laundry water. Modern washing machines are expected to be configured for large loads. In addition, they should support higher rotational speeds of the drum during the spin cycle to reduce the residual moisture in the finished, washed laundry. These increasing demands lead to increasing loads on the flanged-shaft apparatus.

For example, shaft apparatuses are known, in which a star-shaped flange is connected to the drive shaft. The star-shaped flange consists of three arms that extend radially outwards from the drive shaft. According to such a known embodiment, the star-shaped flange is composed of a bent steel plate that is welded to the drive shaft. To increase the rigidity of such a flange, a steel plate of greater plate thickness can be selected, but this would make the assembly heavier overall and would require a more powerful drive apparatus.

In an alternative example, the star-shaped flange is also made of aluminum and is made by means of die-casting in this case. In order to form the connection with the drive shaft, one end of the drive shaft is in this case arranged in the casting mold during the casting process and aluminum is cast around it. The advantage of the die-cast part is that the shape of the flange can be formed with optimized material distribution. In particular, the material thickness and thus the rigidity of the flange can be selected at each point according to the requirements. However, aluminum has a lower modulus of elasticity and thus a lower rigidity than steel. An aluminum flange must therefore be formed from the outset with a greater material thickness than a flange made of steel. If the rigidity of the flange is to be increased due to the increasing requirements, then the die-casting process reaches its limits because the mechanical properties of aluminum deteriorate above a certain material thickness. In addition, such an aluminum flange requires more space in the washing machine, which is often not available.

SUMMARY

It is therefore an object of the invention to provide a flanged-shaft apparatus for stable and reliable rotary suspension of larger drums in the tub.

The invention is based on the consideration of composing the connecting flange of the flanged-shaft apparatus from at least two elements formed from sheet steel, which elements are stacked along the longitudinal axis of the drive shaft and thus along the axis of rotation of the drum. This has the advantage that higher variability in terms of material thickness and material distribution along the connecting flange can be achieved. The fact that at least two steel sheets, namely at least one main element and one supporting element, which are each formed to a certain extent independently of each other, together form the connecting flange means that more degrees of freedom are present. It has been found that precisely these degrees of freedom are sufficient to better meet the different requirements that a flanged-shaft apparatus must meet, namely in particular to ensure sufficient rigidity and a good connection between the connecting flange and the drive shaft, with said flange not being too heavy and fitting into the space provided therefor because of its shape.

The fact that the main element and the supporting element are arranged one on top of the other along the longitudinal axis of the drive shaft means that they are arranged at different positions on the longitudinal axis. The elements can directly follow one another along the longitudinal axis, optionally at a distance, or even touch at points or at surface regions. In certain embodiments, intermediate elements can be arranged between the main element and the supporting element. The longitudinal axis of the drive shaft forms an axis of rotation of the drum in the washing machine. Thus, while the drive shaft extends along the longitudinal axis in a rod shape, the connecting flange extends substantially along a plane that is perpendicular to said longitudinal axis. The connecting flange is fixedly connected to the drive shaft. Unlike in the die-casting method, in which one end of the drive shaft is cast-in during the production of the connecting flange, thus forming a positive connection, the connecting flange is, in the present case, preferably attached to the drive shaft by means of clamping and/or welded or soldered connections.

The connecting flange is preferably mounted so as to be flush with one end of the drive shaft. Preferably, the connecting flange extends in the radial direction substantially up to an edge of the drum or the drum base, in particular up to the drum wall. The drive shaft is connected to the drive motor in the washing machine. The connecting flange preferably has connecting elements by means of which it can be connected to the drum. This connection preferably takes place on the drum base and/or on the drum shell. The connecting elements can be, for example, holes in the connecting flange that optionally have internal threads.

Preferably, the connecting flange is substantially of threefold or manifold (n-type, with $n>3$) rotational symmetry, the longitudinal axis simultaneously forming the rotational symmetry axis. Here, the main element, the supporting element or both of these elements can have said rotational symmetry. In this case, "substantially" means that any minor changes in the appearance of the connecting flange given a corresponding (360°/n) rotation about the rotational axis of symmetry are not detrimental if they do not substantially affect the weight distribution and/or rigidity distribution of the connecting flange. This means, in particular, that markings and adjusting elements, for example adjusting holes, do not put the rotational symmetry into question.

In a preferred embodiment, it is provided that the main element is of a star-shaped design having at least three arms, each of which extends radially outwards from the drive shaft perpendicularly to the longitudinal axis of the drive shaft and along an associated arm axis. In the case of three arms, the associated three arm axes intersect on the longitudinal axis at an angle of 120° with respect to one another. The star-shaped design, in particular in the embodiment having three arms, provides a compromise between rigidity and material savings, for example in comparison with a fully circular disc. Connecting elements for connecting the connecting flange to the drum can be arranged, in particular, on the ends of the arms facing away from the drive shaft. Preferably, the connecting flange has mirror symmetry having an axis of symmetry that is simultaneously an arm axis.

The connecting flange and/or the main element are preferably convex. That is to say, the steel sheet of the main element is, near the longitudinal axis, curved towards the drum base such that it can conform to the drum base while bending in the direction of an end of the drive shaft opposite the connecting flange at a radial distance from the longitudinal axis. If the main element is of a star-shaped design having at least three arms, then the arms are preferably also convex, i.e. they curve towards the drum base. It is preferably provided that at least one of the arms has a hat-shaped cross section in a cross-sectional plane extending perpendicularly to its arm axis. The hat profile provides the corresponding arm with additional rigidity against bending out of the arm axis. Hat-shaped means U-shaped with a kind of hat brim. In particular, it means that the arm cross section has a long side that abuts the drum base and two short sides that adjoin ends of the long side at an obtuse angle. A wall that is substantially parallel to the long side can adjoin the ends of the short sides opposite the long side. In the hat analogy, this wall would be considered the hat brim. Preferably, the arm tapers radially outwards such that the hat becomes smaller in a radially outward direction along the arm axis. Of course, the hat shape is limited only to the two-dimensional cross section.

Preferably, the hat-shaped cross section is supplemented by means of the supporting element to form a box-shaped cross section towards the drive shaft. This means that, at least at a certain position offset from the longitudinal axis along the arm axis, the supporting element has a wall portion that supplements the U-shape to form a rectangle, in particular extends in parallel with the long side in the arm cross section and rests on the ends of the short sides. The box-shaped cross section has increased stability against deformations. The hat-shaped cross section being closed only in the vicinity of the drive shaft while the hat-shaped cross section does not have such a closure further away from the drive shaft has the advantage that material is saved in the outer region of the drum base, while the rigidity of the connecting flange increases towards the drive shaft. This takes into account a radial increase in the load (centrifugal force due to an imbalance) due to the increasing speed and thus the bending load increasing radially in the direction of the axis.

According to a preferred development, the connecting flange has a further supporting element that is arranged on the supporting element along the longitudinal axis in such a way that the main element, the supporting element and the further supporting element form a stack in parallel with the longitudinal axis. The three elements are preferably stacked in such a way that their radial extent decreases along the longitudinal axis and perpendicularly to the longitudinal axis in a direction away from the drum base. In particular, the main element has, in a plan view projection onto a plane perpendicular to the longitudinal axis and/or in a side projection onto a plane parallel to the longitudinal axis, a greater extent than the supporting element. The same preferably applies to the supporting element in relation to the further supporting element. Simply put, the main element is therefore larger than the supporting element, which is in turn larger than the further supporting element.

The further supporting element is preferably also formed from a steel sheet. In a simple embodiment, said further supporting element has the shape of a circular ring, the inner diameter corresponding to the diameter of the drive shaft. The circular edge of the internal hole is also preferably bent into a tubular or sleeve-shaped projection that is arranged, for example, form-fittingly around the drive shaft. Independently thereof, it is also advantageous for the main element to have an internal hole having a further inner edge bent into a tubular or sleeve-shaped projection. In both cases, the sleeve-shaped projections can preferably each form a positive connection with the drive shaft. The supporting element preferably arranged between the further supporting element and the main element must, of course, also have an internal hole for receiving the drive shaft. If the internal hole of the main element has a sleeve-shaped projection, then the internal hole of the supporting element can be formed with a diameter that corresponds to the outer diameter of this sleeve-shaped projection. In this case, the edge of the internal hole of the supporting element would then press the sleeve-shaped projection of the main element further radially against the drive shaft.

According to a preferred embodiment, the main element, the supporting element and/or the further supporting element each has/have an internal hole, in particular a central internal hole or a central hole, into which the drive element is inserted. If such an internal hole is provided, it can have such a smaller diameter relative to the outer diameter of the drive shaft that the corresponding element, i.e. the main element, the supporting element and/or the further supporting element, is annularly pressed radially inwards against the drive shaft from the outside and is thus held by means of a frictional connection. In addition, individual elements can also be interconnected by means of a positive connection and/or a frictional connection.

As an alternative or in addition to a frictional connection, the drive shaft, the main element, the supporting element and/or the further supporting element are preferably soldered and/or welded together. In particular, laser welding can be used for this purpose. A connection that is impermeable to fluids and thus sealed can be made by means of welding or soldering. If, for example, a welded or soldered seam is formed with the drive shaft along one edge of the internal hole of the main element, the supporting element and/or the further supporting element, then moisture is prevented from passing between the flanged-shaft apparatus and the drive shaft and wetting a portion of the drive shaft that faces away from the drum with respect to the seam. If the drive shaft is arranged on the main element, the supporting element and/or the further supporting element, the welding or soldering can preferably be done in an abutting and/or passing manner.

A hermetically sealed cavity is preferably formed by means of the soldering and/or welding, which cavity extends in parallel with the longitudinal axis and is in part delimited by the drive shaft. In this case, the cavity protects at least the part of the drive shaft that forms the delimitation of the cavity. In particular, fluids from the tub cannot get into this cavity in the washing machine such that this part of the drive shaft is already protected against corrosion with the connection to the connecting flange. Therefore, no additional sealing elements are necessary to protect the end of the drive shaft oriented towards the drum against moisture. The drive shaft then does not have to be made of corrosion-resistant material or at least not completely made of corrosion-resistant material either. In this case, hermetically sealed means that, in particular, no fluids and especially no moisture can enter the cavity.

The cavity is preferably annularly arranged around the drive shaft and delimited by one or more of the elements in addition to the drive shaft. Preferably, there are several welded or soldered seams between the drive shaft, the main element, the supporting element and/or the further supporting element, which seams contribute to the hermetic sealing of the cavity; preferably, there are seams involved in all four elements. In particular, the cavity can extend along the surface of the drive shaft between the main element, in particular an internal hole of the main element, and the supporting element or the further supporting element, in particular an internal hole of the supporting element or of the further supporting element.

In a preferred development, a sheet thickness of the main element and/or a total sheet thickness of the connecting flange increases along a radial axis towards the longitudinal axis, the total sheet thickness being defined as the sum of all the sheet thicknesses of the elements that combine at the relevant radial position on the radial axis to form the connecting flange. In simple terms, this means that the sheet thickness or the total sheet thickness increases towards the drive shaft from the outside. This is particularly advantageous if, as usual, the connecting flange is attached to the drum near the outer edge of the drum or of the connecting flange, i.e. radially farthest away from the drive shaft. Such a course of the sheet thickness or the total sheet thickness optimizes the sheet material according to the course of the force input introduced into the connecting flange. This means that, where the force exerted by the drive shaft on the connecting flange is lower, less material is used than where the force acting on the connecting flange is greatest, namely on the drive shaft.

The increase in the sheet thickness and/or the total sheet thickness can be gradual or stepwise. If the increase is gradual, the main element, the connecting flange and/or, in the multi-arm case, as described below, the arm is/are preferably divided into different thickness regions in a direction radially outwards from the drive shaft, in which regions there is a substantially uniform sheet thickness and/or total sheet thickness in each case. When determining the sheet thickness or the total sheet thickness, any localized holes or recesses that serve, for example, for connection or adjustment should preferably be disregarded. Furthermore, in determining the total sheet thickness, possible intermediate spaces extending axially between the individual elements are, by definition, not taken into account. Finally, when determining the total sheet thickness, a possibly locally present oblique position of a steel sheet is not taken into account such that a sheet thickness projected onto the radial axis is calculated. Rather, it is in this case a matter of increasing the rigidity of the connecting flange, which is based primarily on the sheet thickness of the steel sheets used and only then on the deformation of the steel sheets.

An increase in the sheet thickness of the main element means that the main element is formed from a steel sheet having non-uniform thickness. An increase in the total sheet thickness is advantageously achieved in that a number of superimposed elements increases in the direction of the drive shaft. Preferably, the connecting flange only starts with the steel sheet of the main element from a certain radius away from the longitudinal axis, said main element having, for example, a sheet thickness of approximately 2 mm. Closer to the longitudinal axis, the steel sheet of the supporting element is added, said supporting element having, for example, a sheet thickness of approximately 2.25 mm. From this radial position along the radial axis, the connecting flange thus has a total sheet thickness of 2 mm+2.25 mm=4.25 mm. Even closer to the drive shaft, the further supporting element is finally added, said further supporting element having, for example, a sheet thickness of approximately 3 mm. From this radial position up to the drive shaft, the connecting flange then has a total sheet thickness on the radial axis that corresponds to the sum of all three elements, namely 7.25 mm in the present example.

The sheet thickness or total sheet thickness increases along a radial axis, i.e. when a measuring point moves towards the drive shaft perpendicularly to the longitudinal axis of the drive shaft. This is preferably the case for any radial axis, it being possible for there to be some radial axes along which the sheet thickness or total sheet thickness at least does not decrease. Alternatively, the sheet thickness or total sheet thickness increases at least or exclusively along one or some particular radial axes. If the connecting flange and/or the flanged-shaft apparatus is/are formed with a plurality of arms, the radial axis is, in particular, an arm axis.

The assembly of the connecting flange comprising a main element and a supporting element is preferably reminiscent of a framework structure as is also used in the construction of aircraft wings, having at least one top chord and one bottom chord. The clamping of the upper and lower chord ensures optimum absorption of the dominant load in the sense of an alternating tension-thrust load. Such structures also have high rigidity. According to a preferred embodiment, it is additionally provided that the drive shaft, the main element, the supporting element and/or the further supporting element forms one or more substantially triangular structure(s) in a sectional plane in which the longitudinal axis extends. In particular, this means that the intersection edges of interconnected elements of the connecting flange each form legs of one or more triangles in the sectional plane, which legs are preferably also connected to each other at least in pairs. Such a truss structure or structure based on a truss has increased rigidity. The triangular structure(s) serve, in particular, for improved load distribution within the connecting flange. That is to say, the individual legs of the triangular structure(s) can serve to relieve or transfer the load between elements and portions of the connecting flange.

The sectional plane is defined by the longitudinal axis and by an axis that projects radially from the longitudinal axis. If the feature with respect to the increasing sheet thickness and/or total sheet thickness along a radial axis is also fulfilled, the sectional plane can be defined by the longitudinal axis and the radial axis. Alternatively or additionally, the feature with respect to the triangular structure(s) in a sectional plane that is defined by the longitudinal axis and a further radial axis arranged perpendicularly to the longitudinal axis and to the radial axis can be fulfilled. One or more triangular structure(s) can also be formed in substantially all (an infinite number of) sectional planes on which the longitudinal axis lies. In this case, the triangular structure(s) is/are a cross section of an annular, closed structure in the connecting flange. If the connecting flange and/or the flanged-shaft apparatus is/are formed with a plurality of arms, the radial axis is, in particular, an arm axis. In other words, the sectional plane in which the triangular structure (s) is/are formed is preferably defined by the longitudinal axis and one of the arm axes.

A leg of a triangular structure produced by a sheet metal portion can but does not necessarily have to form a straight line in the sectional plane. Rather, it is not detrimental for the leg to have an internal bend, for example to make possible or allow a connection with another element of the connecting flange. In particular embodiments, two legs of a triangular structure can be formed by a bent steel sheet such that the bending point forms a corner enclosed by said two legs. Preferably, a triangular structure is formed by the main element and the supporting element. Additionally or alternatively, a triangular structure is preferably formed by the drive shaft, the supporting element and the further supporting element.

The main element, the supporting element and/or the further supporting element preferably each have a sheet thickness of between 0.5 mm and 6 mm, preferably between 1 mm and 4 mm, it being possible for the sheet thicknesses to differ from each other. The sheet thickness preferably increases from the main element to the supporting element and/or from the supporting element to the further supporting element.

Preferably, the main element, the supporting element and/or the further supporting element is/are formed as a stamped bending element or stamped bending elements. Such elements can be produced inexpensively with great precision and high throughput.

The invention further relates to a washing machine having a tub, a flanged-shaft apparatus according to any of the embodiments described above or below, and a drum rotatably supported in the tub by means of the flanged-shaft apparatus.

An embodiment of the invention is shown in the drawings in a purely schematic manner and will be described in more detail below.

DETAILED DESCRIPTION OF THE DRAWINGS

Figure 1:
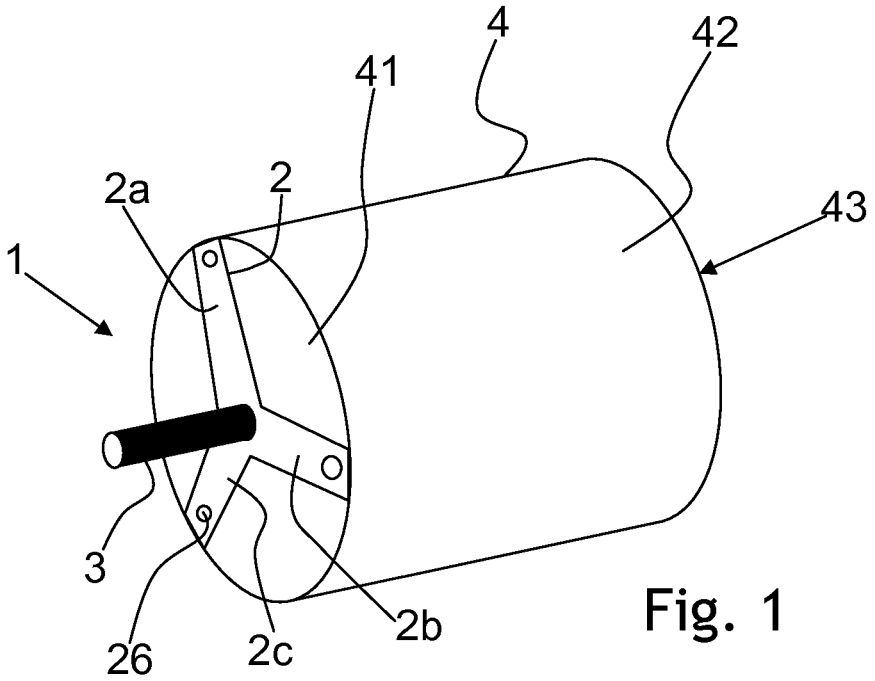
FIG. 1 is a schematic view of a drum having a flanged-shaft apparatus according to a preferred embodiment attached thereto.

FIG. 1 is a schematic view of a drum 4 having a flanged-shaft apparatus 1 attached thereto. The flanged-shaft apparatus 1 is composed of a drive shaft 3 and a connecting flange 2. The drum 4 is cylindrical and has a drum shell 42, a drum base 41 and a drum opening 43 opposite the drum base 41 and not visible in FIG. 1. The connecting flange of the flanged-shaft apparatus 1 indicated in FIG. 1 is star-shaped and has three arms 2*a*, 2*b*, 2*c*. A connecting element 26 is indicated at the outer end of each arm 2*a*, 2*b*, 2*c*. The connecting flange 2 is connected to the drum 4 by means of the connecting elements 26, it being possible for the connecting flange 2 to be connected either to the drum base 41 or preferably additionally to the drum shell 42, for example by means of threaded rods that extend along the entire length of the drum shell 42.

Figure 2:
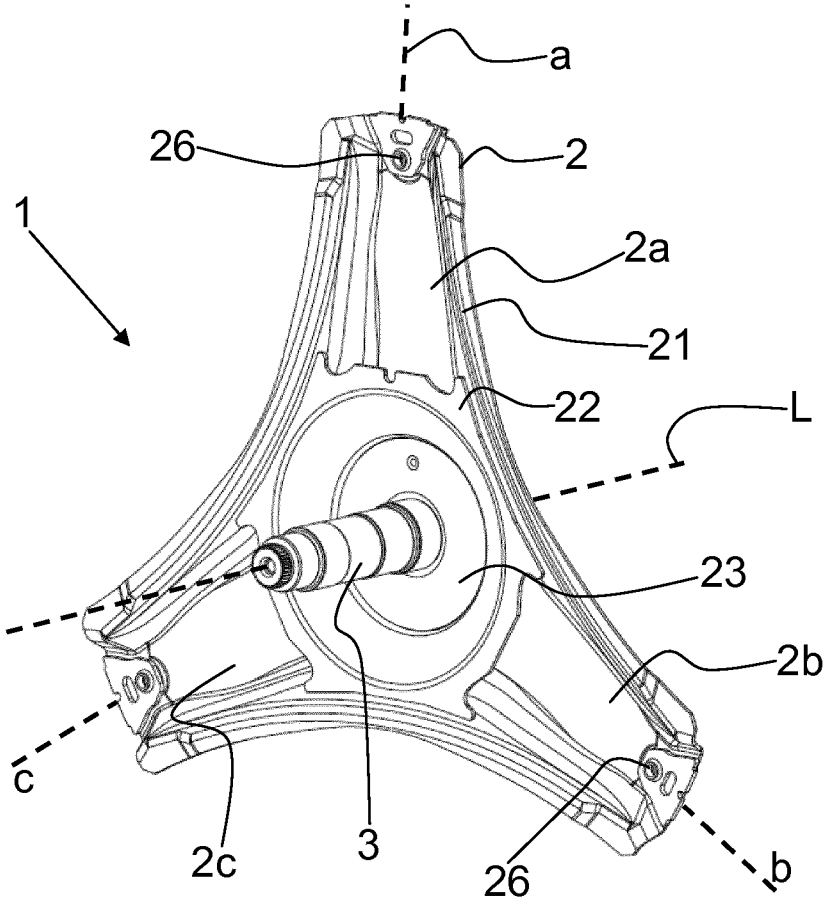
FIG. 2 is a perspective view of the side of a flanged-shaft apparatus according to a preferred embodiment facing away from the drum.

FIG. 2 is a perspective view of the side of a flanged-shaft apparatus 1 according to a preferred embodiment facing away from the drum 4. The drive shaft 3 is cylindrical and extends along a longitudinal axis L. When installed in a washing machine (not shown), the longitudinal axis L is equal to an axis of rotation about which the drum 4 rotates. The star-shaped, three-arm design of the connecting flange 2 is clearly visible in FIG. 2. In this case, the connecting flange 2 is composed of a main element 21, a supporting element 22 and a further supporting element 23. These three elements 21, 22, 23 are stacked along the longitudinal axis L and connected to the drive shaft 3.

In the present embodiment, the main element 21 substantially defines the star-shaped form of the connecting flange 2 and has three arms 2*a*, 2*b*, 2*c*, each of which extends radially outwards from the longitudinal axis L along a corresponding arm axis a, b, c. The three arm axes a, b, c each have an angle of 120° relative to each other in pairs. The supporting element 22 can also be referred to as star-shaped and three-armed, but the three arms are extremely short. As will be explained below, this serves to save material. As a result, the supporting element 22 has more of a hexagonal shape. The element stack or sheet stack is completed by the further supporting element 23, which is circular and has a central hole, that is it has an annular design.

Figure 3:
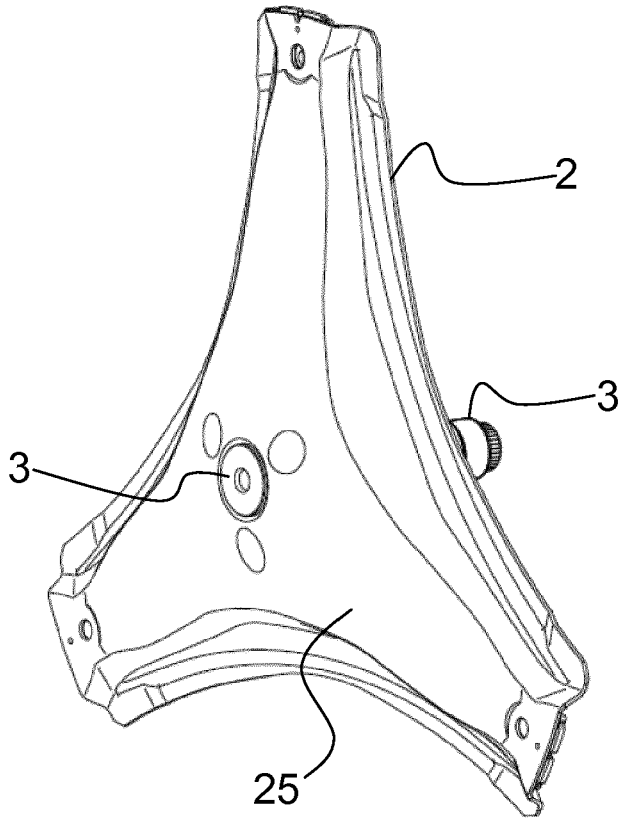
FIG. 3 is a perspective view of a flange rear side of the flanged-shaft apparatus from FIG. 2 facing the drum.

FIG. 3 is a perspective view of a flange rear side 25 of the flanged-shaft apparatus 1 from FIG. 2 facing the drum 4. The flange rear side 25 is formed by a surface of the main element 21. It is convex and fits snugly into a concave cavity of the drum base 41 when attached to the drum 4.

Figure 4:
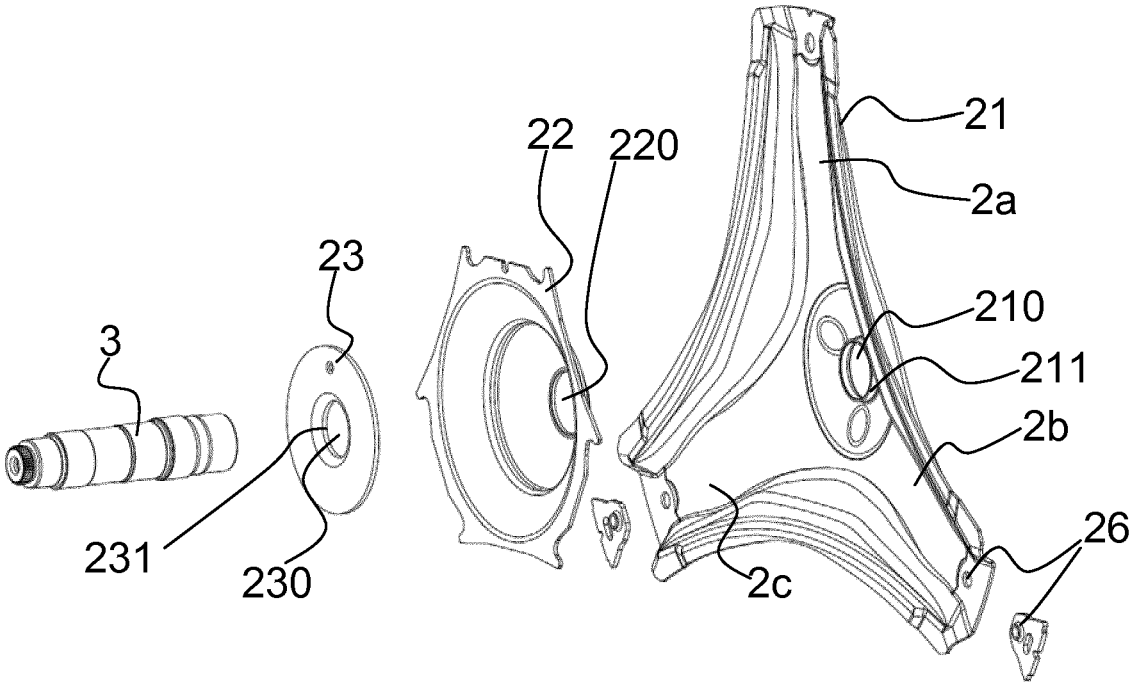
FIG. 4 shows the flanged-shaft apparatus from FIGS. 2 and 3 in an exploded view.

An exploded view of the flanged-shaft apparatus 1 from FIGS. 2 and 3 is shown in FIG. 4. In this case, it can be seen in particular that each of the connecting elements 26 is formed from a hole in the relevant arm 2*a*, 2*b*, 2*c* of the main element 21 and in each case additionally from a small plate that acts as a nut for a threaded rod. In addition, it can be seen in FIG. 4 that all three elements 21, 22, 23 each have an internal hole 210, 220, 230 into which the drive shaft 3 is inserted. It should also be mentioned here that the main element 21 and the supporting element 22 have threefold rotational symmetry about the longitudinal axis L as an axis of symmetry. In contrast, the further supporting element is rotationally symmetrical, likewise about the longitudinal axis L.

The edge of the internal hole 210 of the main element 21 is bent substantially in parallel with the longitudinal axis L to form a sleeve-like projection 211. Likewise, the internal hole 230 of the further supporting element 23 has such a sleeve-like projection 231. These two projections 211, 231 serve to increase the connecting surface between the main element 21 and the drive shaft 3 and between the further supporting element 23 and the drive shaft 3.

Figure 5:
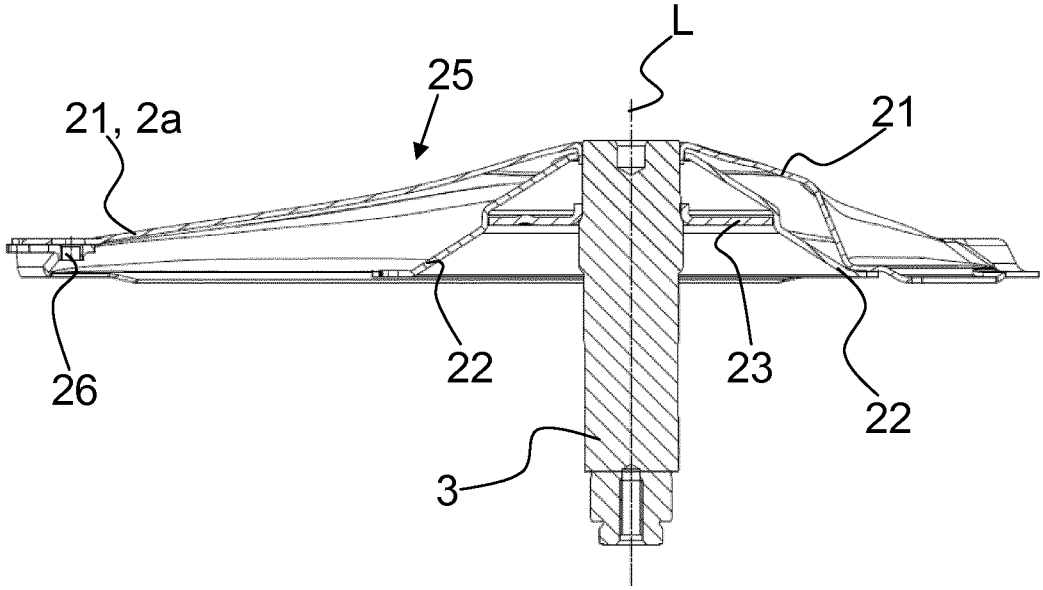
FIG. 5 is a sectional view of the flanged-shaft apparatus from FIGS. 2 and 3.

FIG. 5 is a sectional view of the flanged-shaft apparatus 1. In this case, the sectional plane is defined by the longitudinal axis L and an arm axis a. The resulting intersection edges are shown as hatched areas. The main element 21, the supporting element 22 and the further supporting element 23 are formed from stamped sheet metal, in particular steel sheets, preferably made of stainless steel.

Figure 6:
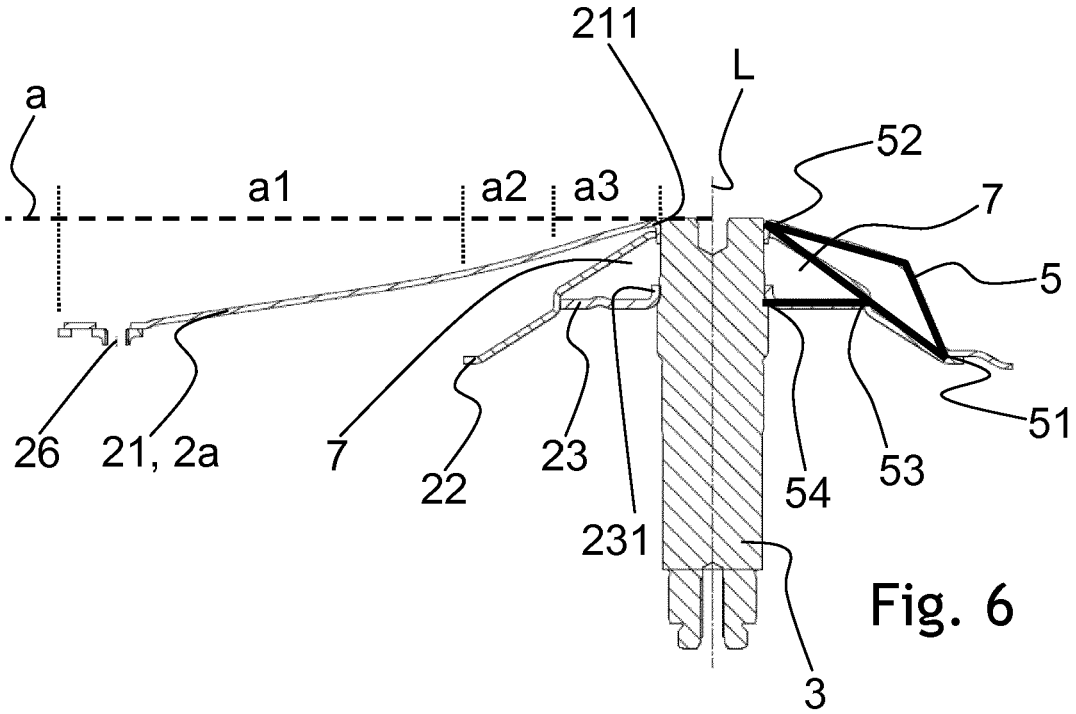
FIG. 6 is a cross-sectional view of the flanged-shaft apparatus from FIG. 5.

FIG. 6 is a cross-sectional view of the flanged-shaft apparatus in the same sectional plane as in FIG. 5. In comparison with the sectional view from FIG. 5, only the intersection edges of the different elements with the sectional plane are shown in the cross-sectional view. Furthermore, auxiliary lines are shown in FIG. 6 in order to illustrate the mechanical interaction of the different elements of the flanged-shaft apparatus 1. These are, in particular, two different features that will be explained below with reference to FIG. 6. These features can be used independently in other embodiments, but cooperate in the present embodiment to increase the rigidity of the flanged-shaft apparatus. The first feature is a previously explained increase in a total sheet thickness, which is illustrated on the left-hand side of the drive shaft 3 in FIG. 6. As the second feature, the presence of triangular structures likewise explained above is illustrated in FIG. 6 on the right-hand side of the drive shaft 3.

An arm axis a, indicated by a dashed line in FIG. 6, of the arm 2*a* of the main element 21, which is visible here in cross section, is divided into three thickness regions a1, a2, a3. The arm axis a, like the other two arm axes b, c, is a radial axis. The first thickness region a1 is the projection of only the region of the connecting flange 2 having only the main element 21 onto the arm axis a. In the second thickness region a2, the supporting element 22 is added, while the further supporting element 23 also has a share in the third thickness region a3. In the case of sheet thicknesses of 2 mm for the main element 21, of 2.25 mm for the supporting element 22 and of 3 mm for the further supporting element 23, the following total sheet thicknesses result in the three thickness regions a1, a2, a3 for the connecting flange 2: In the first thickness region a1, the total sheet thickness is equal to the sheet thickness of the main element, namely also 2 mm. In the second thickness region a2, the sheet thicknesses of the main element 21 and of the supporting element 22 add up to a total sheet thickness of 4.25 mm. In the third thickness region a3, the sheet thicknesses of the main element 21, of the supporting element 22 and of the further supporting element 23 add up to a total sheet thickness of 7.25 mm.

The total thickness of the sheet metal, which increases towards the drive shaft 3, serves to, if possible, introduce the material of the connecting flange 2 where a corresponding force input takes place. The forces acting on the connecting flange 2 due to bending moments are still comparatively low near the connecting element 26 for connection to the drum 4. These forces increase along the arm axis a in the direction of the drive shaft 3. As a result of the three-step increase in the total sheet thickness, the rigidity of the connecting flange 2 correspondingly increases from the outside towards the arm axis 3 in order to cope with the increase in force. It should also be noted that, in this consideration, the portion of the supporting element 22 that extends substantially vertically due to a double bend does not, at its junction to the further supporting element 23, additionally contribute to the determined total sheet thickness for the connecting flange 2, rather it is only the sheet thickness of the steel sheet used during the production of the supporting element 22 that is considered.

The portion of FIG. 6 to the right of the drive shaft 3 serves to illustrate the truss structure. The truss structure is also in part realized on the left-hand side, namely with the triangle formed or enclosed by the supporting element 22, the further supporting element 23 and the drive shaft 3. This triangle can also be seen on the right-hand side because it is annularly arranged around the drive shaft 3 with rotational symmetry. On the right-hand side, this triangle is formed by the connecting points 52, 53 and 54, which are formed between the main element 22 and the drive shaft 3, between the supporting element 22 and the further supporting element 23 and between the further supporting element 23 and the drive shaft 3. A further triangular structure or triangle 5, which is responsible for the distribution of bending loads, is defined by the connecting points 51, 52 and a bend, which bend is formed in the steel sheet of the main element 21 at a position opposite the arm 21 in an extension of the arm axis 2*a*. The leg of the triangle 5 between the connecting points 51 and 52 has an S-shaped bend in the steel sheet. This bend can be seen more clearly in FIG. 5 because no auxiliary lines obstruct the view of the illustration of the triangle 5 there. However, this bend has little influence on the stiffening effect of the leg between the connecting points 51 and 52 such that the distance between the connecting points 51 and 52 can be considered a substantially rigid strut for the analysis of the force distribution.

The force distribution in the structure shown in FIG. 6 will be explained below: When force is introduced (due to the drum 4, which is not shown here) in the axial direction parallel to the longitudinal axis L on the connecting element 26, i.e. at the outer end of the arm 2*a*, a bending load is exerted on this arm 2*a* of the main element 21. This load is transmitted from the main element 21 to the drive shaft 3. The supporting element 22 and the further supporting element 23 serve to optimize rigidity and to relieve the main element 21 and the drive shaft 3, as well as to relieve the connecting points 52, 54 between the connecting flange 2 and the drive shaft 3. The greatest bending loads occur at these connecting points 52, 54.

A framework structure, in particular a truss structure, is constructed by means of the connecting points 51 and 52, as well as with the use of the further supporting element 23 and its connection to the supporting element 22 at the connecting point 53. Upon introduction of the axial force on the connecting element 26 into the main element 21, the bending load is thus transmitted into the supporting element 22 via the connecting point 52 and is supported via the connecting points 53 on the second supporting element 23. As a result, a considerable reduction of the occurring loads can be realized in the connecting points 52 and 54 to the drive shaft 3.

In order to increase the connecting surface with the drive shaft 3, the main element 21 and the further supporting element 23 each have, as explained above in connection with FIG. 4, a sleeve-shaped projection 211, 231 on their internal holes 210, 230, which sleeve-shaped projection annularly surrounds the drive shaft 3. These projections 211, 231 are attached to the drive shaft 3 by means of annular welded seams, in particular by means of laser welding.

The above-described triangle, visible in FIG. 6, consisting of the connecting points 52, 53, 54 is also the cross section of a cavity 7 that is annularly formed around the drive shaft 3. Because of annular welded seams that connect the supporting element 22 to the drive shaft 3 (connecting point 52), the supporting element 22 to the further supporting element 23 (connecting point 54) and the further supporting element 23 to the drive shaft 3 (connecting point 53), the cavity 7 is hermetically sealed such that no moisture can get to the surface region of the drive shaft 3 between the two welded seams at the connecting points 52 and 54 from the tub (not shown in the figures) and cause corrosion.

Each of the three arms 2*a*, 2*b*, 2*c* of the main element 21 has, in a corresponding cross-sectional plane perpendicular to the relevant arm axis a, b, c, a hat-shaped cross section that increases in size in the direction of the longitudinal axis L. The hat-shaped cross section is supplemented closer to the longitudinal axis, namely in the thickness region a2 according to FIG. 6, by means of the supporting element 22 to form a box-shaped cross section. Finally, the further supporting element 23 is added such that a truss structure, as shown on the right-hand side in FIG. 6, is formed on the drive shaft 3 itself. This transformation of the cross section of the arm 2*a* will be explained with reference to the following FIGS. 7, 8 and 9 and also as representative for the other two arms 2*b*, 2*c*.

Figure 7:
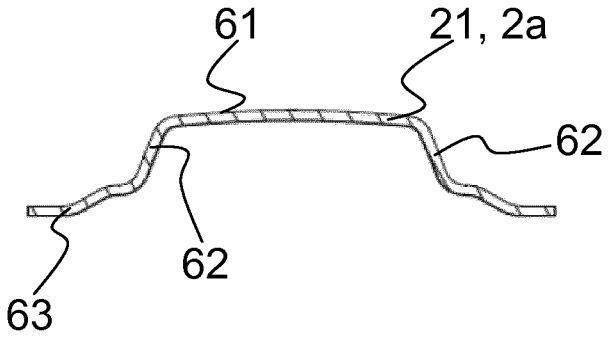
FIG. 7 is a cross-sectional view of the flanged-shaft apparatus from FIG. 5 in a cross-sectional plane perpendicular to an arm axis of one of three arms, far from a longitudinal axis.

FIG. 7 is a cross-sectional view of the flanged-shaft apparatus 1 in the cross-sectional plane perpendicular to the arm axis a, far from the longitudinal axis L. The hat-shaped structure can be seen here, which structure is composed of a long side 61, two short sides 62 adjoining thereto and one wall 63 that extends approximately in parallel with the long side 61. The cross-sectional plane of FIG. 7 is, when looking at FIG. 6, approximately midway between the thickness region a2 and the connecting element 26. The hat-shaped profile will flatten towards the connecting element 26, as can be seen, for example, in FIG. 3.

Figure 8:
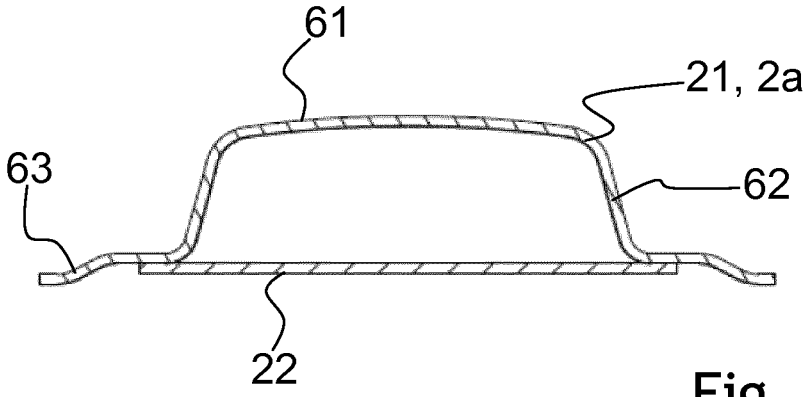
FIG. 8 is a cross-sectional view of the flanged-shaft apparatus from FIG. 5 in a further cross-sectional plane perpendicular to the same arm axis as in FIG. 7, closer to the longitudinal axis.

FIG. 8 is a cross-sectional view of the arm 2*a* in a further cross-sectional plane perpendicular to the arm axis a, but closer to the longitudinal axis, namely in the thickness region a2, directly following the thickness region a1. Here, it can clearly be seen that the hat-shaped cross section is supplemented to form a box-shaped cross section that is composed of the long side 61, the two short sides 62 and an, in this case, flat portion of the supporting element 22.

Figure 9:
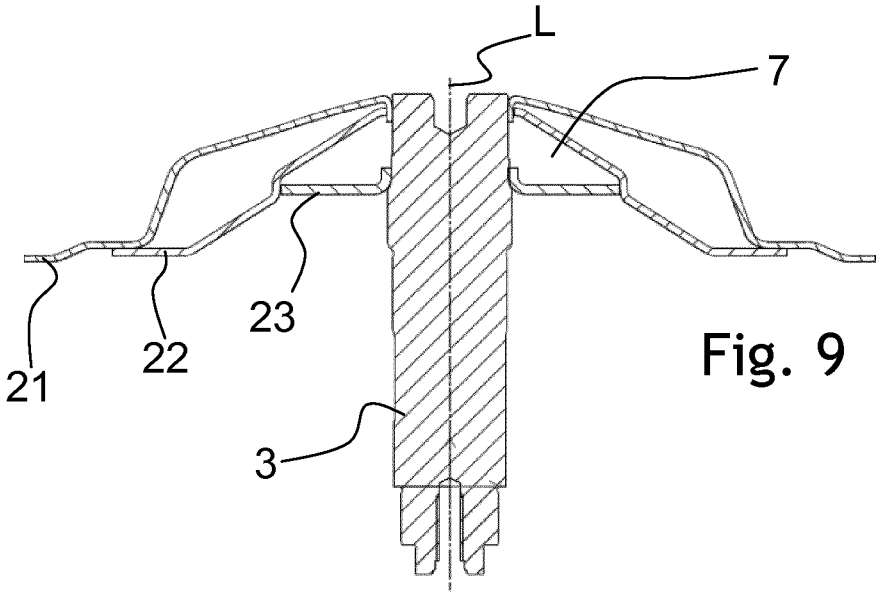
FIG. 9 is a cross-sectional view of the flanged-shaft apparatus from FIG. 5 in a further cross-sectional plane perpendicular to the same arm axis as in FIGS. 7 and 8, along the longitudinal axis.

Finally, FIG. 9 shows a cross-sectional view of the arm 2*a* in a further cross-sectional plane perpendicular to the arm axis a, but along the longitudinal axis L. As can be seen in FIG. 9, the initially hat-shaped and then box-shaped cross section transitions into a truss structure already known from FIG. 6. In the present case, however, the truss structure is identical on both sides of the drive shaft 3 or the longitudinal axis L. On account of the course of the cross-sectional profile illustrated in FIGS. 7, 8 and 9, the rigidity behavior of the connecting flange 2 is optimized in accordance with an axially increasing bending load by increasing the section modulus towards the drive shaft 3 in the axial direction along the arm axis a through the targeted use of different profile types. This is done starting with a hat profile according to FIG. 7 and continuing to additional bracing in a truss-like profile according to FIG. 9 via a closed box profile according to FIG. 8. In addition, unnecessary material doubling is avoided in the outer region, i.e. far away from the longitudinal axis L.

REFERENCE SIGNS

1 flanged-shaft apparatus
2 connecting flange
21 main element
2*a*, 2*b*, 2*c*, arms
a, b, c arm axes
a1, a2, a3 thickness regions along a radial axis
210 internal hole, main element
211 sleeve-shaped projection, main element
22 supporting element
220 internal hole, supporting element
23 further supporting element
230 internal hole, further supporting element
231 sleeve-shaped projection, further supporting element
25 flange rear side
26 connecting element
3 drive shaft
L longitudinal axis
4 drum
41 drum base
42 drum shell
43 drum opening
5 triangular structure, triangle
51, 52, 53, 54 connecting points
61 long side
62 short sides
63 wall, hat brim
7 cavity

What is claimed is:

1. A flanged-shaft apparatus (1) for rotatably supporting a drum (4) in a washing machine, the flanged shaft comprising:

a connecting flange (2) configured to be arranged against a drum base (41) of the drum (4) and to be attached to the drum (4), the connecting flange having a center configured to coincide with an axis of rotation of the drum, and a drive shaft (3) arranged in the center of the connecting flange (2) and connected thereto for connecting the connecting flange to a drive motor, wherein the connecting flange (2) includes a main element (21) formed from a steel sheet and a supporting element (22) formed from a further steel sheet, the main element (21) and the supporting element (22) being arranged offset from one another along a longitudinal axis (L) of the drive shaft (3).

2. The flanged-shaft apparatus (1) according to claim 1, wherein the main element (22) is star-shaped and has at least three arms, each of which extends radially outwards from the drive shaft (3) perpendicularly to the longitudinal axis of the drive shaft (3) and along a respective associated arm axis (a, b, c).

3. The flanged-shaft apparatus (1) according to claim 2, wherein at least one of the arms (2*a*; 2*b*; 2*c*) has a hat-shaped cross section in a cross-sectional plane extending perpendicularly to its arm axis (a, b, c).

4. The flanged-shaft apparatus (1) according to claim 3, wherein the hat-shaped cross section is supplemented by the supporting element (22) to form a box-shaped cross section near the drive shaft (3).

5. The flanged-shaft apparatus (1) according to claim 1, wherein the connecting flange (2) has a further supporting element (23) that is arranged on the supporting element (22) along the longitudinal axis in such a way that the main element (21), the supporting element (22) and the further supporting element (23) form a stack in parallel with the longitudinal axis.

6. The flanged-shaft apparatus (1) according to claim 1, wherein at least two of the drive shaft (3), the main element (21), and the supporting element (22) are soldered or welded together.

7. The flanged-shaft apparatus (1) according to claim 4, wherein a hermetically sealed cavity (7) is formed between the main element (21) and the supporting element (22) by soldering or welding, wherein the cavity (7) extends around the longitudinal axis and is in part delimited by the drive shaft (3).

8. The flanged-shaft apparatus (1) according to claim 1, wherein a sheet thickness of the main element (21) increases along a radial axis towards the longitudinal axis.

9. The flanged-shaft apparatus (1) according to claim 1, wherein the drive shaft (3), the main element (21), and the supporting element (22) form at least one substantially triangular structure in a sectional plane in which the longitudinal axis extends.

10. The flanged-shaft apparatus (1) according to claim 9 when dependent on claim 2, characterized in that the sectional plane in which the triangular structure(s) are formed is defined by the longitudinal axis (L) and one of the arm axes (a; b; c).

11. The flanged-shaft apparatus (1) according to claim 1, wherein the main element (21) and the supporting element (22) are stamped bending elements.

12. A washing machine comprising a tub, a flanged-shaft apparatus (1) according to claim 1, and a drum (4) rotatably held in the tub by the flanged-shaft apparatus (1).

13. The flanged-shaft apparatus (1) according to claim 5, wherein the drive shaft (3), the main element (21), the supporting element (22) and the further supporting element (23) form at least one substantially triangular structure in a sectional plane in which the longitudinal axis extends.

14. The flanged-shaft apparatus (1) according to claim 1, wherein a combined sheet thickness of the main element and the supporting element of the connecting flange (2) increases along a radial axis towards the longitudinal axis.

15. The flanged-shaft apparatus (1) according to claim 5, wherein a total sheet thickness representing a sum of sheet thicknesses of the main element, of the supporting element, and of the further supporting element of the connecting flange (2) increases along a radial axis towards the longitudinal axis.

* * * * *